US005184834A

United States Patent [19]

Yu

[11] Patent Number: 5,184,834

[45] Date of Patent: Feb. 9, 1993

[54] SKATE SHOE HAVING AN ADJUSTABLE PLATE MOUNTED THERETO

[76] Inventor: Chung-Hsiung Yu, 2F, No. 94, Chung-Yuan St., Taipei City, Taiwan

[21] Appl. No.: 770,985

[22] Filed: Oct. 1, 1991

[51] Int. Cl.[5] ..... A63C 17/18; A63C 1/22

[52] U.S. Cl. ..... 280/7.13; 280/11.16; 280/11.26; 280/11.32

[58] Field of Search ..... 280/7.13, 11.16, 11.26, 280/11.27, 11.31, 11.32, 11.33, 11.34; 36/1, 97, 102, 115

[56] References Cited

U.S. PATENT DOCUMENTS

| | | | |
|---|---|---|---|
| 492,272 | 2/1893 | Comfort | 36/115 X |
| 1,458,243 | 6/1923 | Reach | 280/11.26 |
| 1,910,193 | 5/1933 | Ware | 280/11.27 X |
| 2,252,315 | 8/1941 | Doree | 36/102 X |
| 2,531,357 | 11/1950 | Foulds | 280/11.27 X |
| 4,379,564 | 4/1983 | Welker | 280/11.27 X |
| 4,708,352 | 11/1987 | Vullierme | 280/11.3 X |
| 4,944,099 | 7/1990 | Davis | 36/102 X |
| 5,046,746 | 9/1991 | Gierveld | 280/11.27 X |

FOREIGN PATENT DOCUMENTS

| | | | |
|---|---|---|---|
| 8101948 | 7/1981 | World Int. Prop. O. | 36/97 |

*Primary Examiner*—Charles A. Marmor
*Assistant Examiner*—Brian L. Johnson
*Attorney, Agent, or Firm*—Ladas & Parry

[57] ABSTRACT

A skate shoe has a sole plate and a skating unit which is detachably attached to the sole plate. The sole plate includes a front section, a rear section spaced from the front section and a connecting member adjustably interconnecting the front and rear sections. The front section has a toe cup provided on an upper side of the front section. The rear section has a heel cup provided on an upper side of the rear section. A fixing device provided between the heel cup and the toe cup, holds a foot inserted between them in a firm position.

9 Claims, 5 Drawing Sheets

SKATE SHOE HAVING AN ADJUSTABLE PLATE MOUNTED THERETO

BACKGROUND OF THE INVENTION

1. Field of Invention

This invention relates to a skate shoe, more particularly to a sole plate for constructing a skate shoe whose length can be adjusted so that said skate shoe can be worn by any individual having feet of any size.

2. Description of the Related Art

FIG. 1 shows a conventional roller-skate comprising a front section (A), a rear section (B) and a connecting member (C) adjustably interconnecting the front and rear sections. Each of the front and rear sections has a lace which is tied to a front portion and a rear portion of a sport shoe before a person can skate on it. Often the roller-skate will disengage from the sport shoe during skating due to numerous reasons causing the skater to fall and thereby hurt himself. Therefore, such a roller-skate is not reliable.

FIG. 2 shows another type of roller-skate comprising a skate base (F) upon which a sport shoe (E) is fixedly attached. Though such a roller-skate can provide stability for a skater, it can not be worn by every one since the length of the sole plate is fixed and can not be adjusted. Therefore, each skater must buy a pair of roller-skates for his own personal use and can not share with other people whose feet are not the same size. Also since skating is done occasionally, a young player, whose feet are constantly growing day by day, will be annoyed to find that his roller-skates do not fit him any more the next time he uses them. Buying a new pair is not feasible since young skaters are generally into wage earners.

SUMMARY OF THE INVENTION

Therefore, it is a main object of the present invention to provide a roller skate having a sole plate, the length of which can be adjusted in order to anyone's feet.

Another object is to provide a roller-skate having a sole plate of the present invention which is adapted to be worn by every skater so that the cost per person is reduced.

Still another object is to provide a roller-skate having the sole plate of the present invention after the length of which is adjusted, can provide a comfortable supportive feeling to a wearer.

Accordingly, a sole plate of the present invention to be used in conjunction with a roller-skate includes a front section and a rear section which is spaced from the front section and a connecting member adjustably interconnects the front and rear sections. The front section has a toe cup provided on the top side thereof. The rear section has a heel cup spaced from the toe cup and is provided on the top side thereof. Each of the front and rear sections is mounted on a pair of the rollers of the roller-skate. A pair of VELCRO fastening are mounted on the toe cup and heel cup and interconnect the former and latter into a firm position after a wearer's foot is inserted.

BRIEF DESCRIPTION OF THE DRAWINGS

Other features and advantages of the present invention will become more apparent in the following detailed description, including drawings, all of which show a non-limiting form of the invention, and of which.

DETAILED DESCRIPTION OF THE PREFERRED EMBODIMENT

Figure 1:
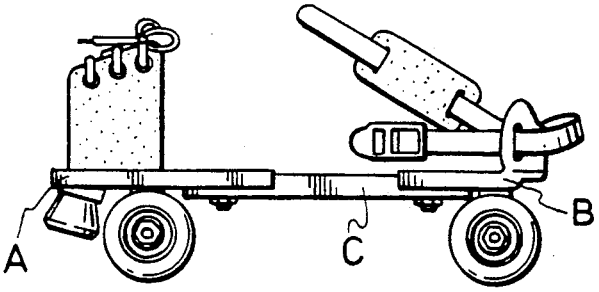
PRIOR ART FIG. 1
FIG. 1 shows a conventional roller-skate.
Figure 2:
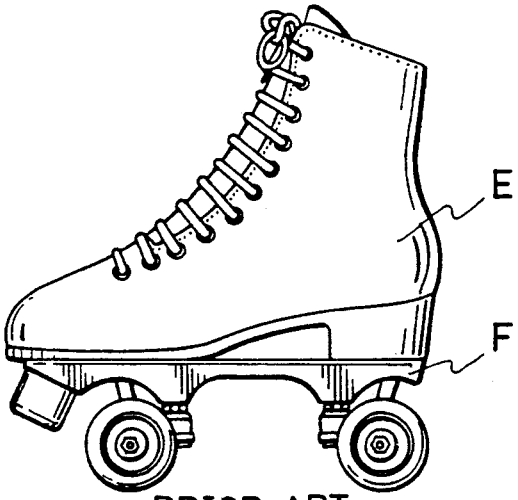
PRIOR ART FIG. 2
FIG. 2 shows an improved conventional roller-skate.

The present invention does not relate to a shoe but rather a sole plate for constructing a shoe, and is particularly intended for a roller-skate shoe. The construction method can be any suitable are known in the art, and therefore will not be described in detail in the following specification.

Referring to FIGS. 3, 4, 5 and 6, a sole plate for constructing a roller-skate shoe is shown to comprise mainly a front section (1), a rear second (2), and a connecting member (3) adjustably interconnecting the front and rear sections.

The front section (1) is made up of an upper partition (10) and a lower partition (11) which cooperatively define a first chamber (12) therebetween. The connection relationship of the lower partition and the upper partition can be any suitable method so long as they can form a chamber therebetween. The upper partition (10) has a medial elongated recess portion (101) and the lower partition (11) has two parallel elongated slots (110) so that the front section (1) can be mounted on a pair of rollers by screws (111) which protrude through these slots.

The construction of the rear section (2) is exactly similar to the first section, so that it also has a second chamber (22) confined by the two partitions (20,21), and is positioned in alignment with the first chamber (12). The upper partition (20) has a medial elongated recess portion (201) and the lower partition (21) has two parallel elongated slots (210) so that the rear section (2) can be mounted on a pair of rollers by screws (211) which protrude through these slots.

The connecting member (3) is an elongated plate with a pair of elongated slots (30) spaced apart and in alignment with one another. It is inserted into the first and second chambers (12,22) in such a way that the connecting member (3) is sandwiched between the medial elongated recess portions (101,201) of the upper partitions (10,20) of the front and rear sections (1,2) and the lower partitions (11,21) of the front and rear sections thereof.

Thus the connecting member (3) supports the rigidity of the upper partitions (10.20). The spaced distance between the front and rear sections (1.2) can be adjusted by using a rivet (31) or other means inserted through the elongated slots (30) of the connecting member (3) so that a sole plate thus constructed can fit a foot of variable sizes.

The upper partitions (10,20) of the front and rear sections, (1,2) have a plurality of holes (102,202) therein. A toe cup (13) with eyelets (130) and a heel cup (23) with eyelets (230) can be respectively riveted in these holes (102,202) or by any other suitable method.

Figure 7:
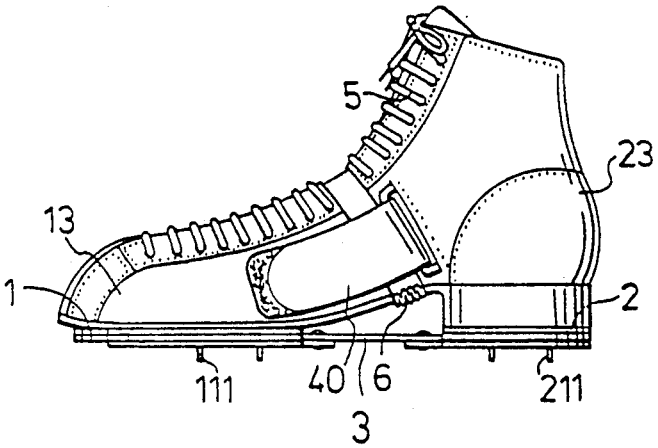
FIG. 7 is a side view of the skate shoe constructed by using the sole plate of the present invention, being illustrated before the skating rollers are mounted thereto.

FIG. 7 shows a shoe having a sole plate made according to the above-mentioned manner before being fixed with rollers. The toe cup (13) and the heel cup (23) are not integrally formed as in a conventional skate shoe but are separated so that the spaced apart distance between the front and rear sections (1,2) can be adjusted by using the connecting member (3). Separation of the toe cup from the heel cup weakens the properly fit feeling of a wearer. To compensate for this weakened feeling, VELCRO fastener straps are connected to both the front and rear sections. The VELCRO fasteners are connected to the rear section via ring buckle (41) which is attached to the rear section. Thus a foot can be firmly held therein without facing disengagement during the skating operation.

Figure 8:
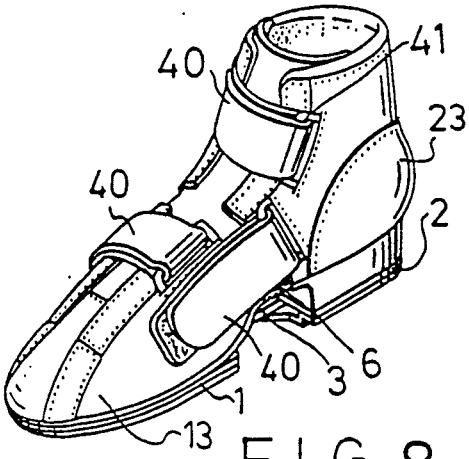
FIG. 8 shows another preferred embodiment of a shoe constructed by using the sole plate of the present invention, illustrating the preferred embodiment before the skating rollers are mounted thereto.

For quick-release and quick-fastening purposes, some more VELCRO fastener straps (40) can be used instead of a conventional lace (5), as shown in FIG. 8. A stretchable and retractable strip or pleated sole part (6) can be provided between the toe cup (13) and the heel cup (23) to help hold a foot firmly in the shoe.

Figure 3:
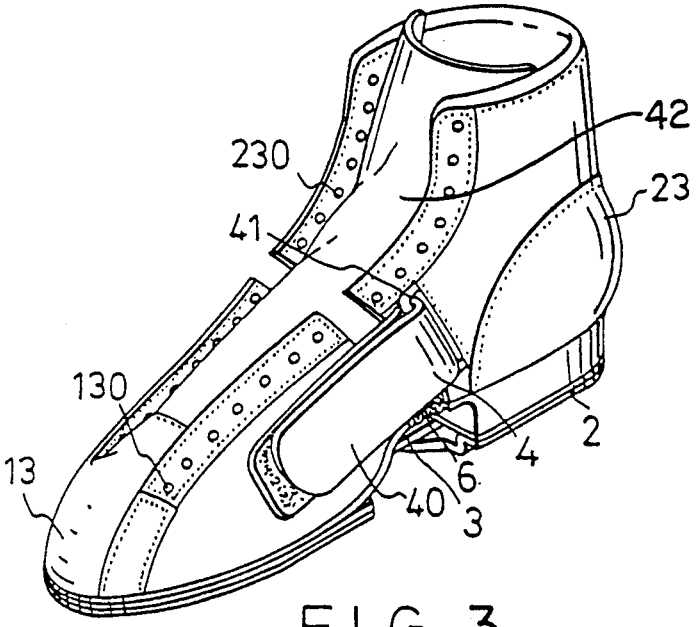
FIG. 3 shows a perspective, schematic view of a roller-skate shoe constructed by using a sole plate of the present invention before the rollers are mounted thereto.
Figure 4:
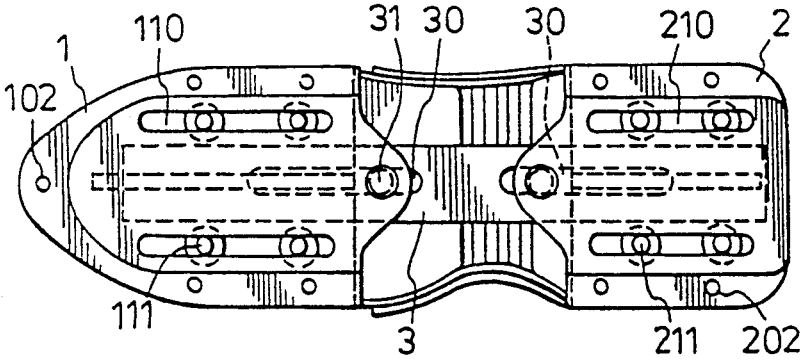
FIG. 4 is a bottom view of a sole plate of FIG. 3.
Figure 5:
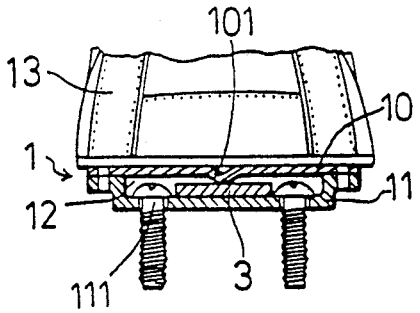
FIG. 5 is a cross sectional view of the front section of the preferred embodiment of the present invention.
Figure 6:
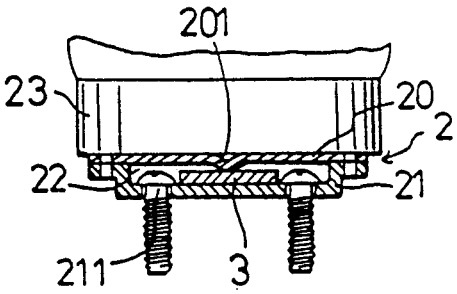
FIG. 6 is a cross sectional view of the rear section of the preferred embodiment of the present invention.

An instep gusset sheet (42) extends from the anterior shoe part to the posterior shoe part as best shown in FIG. 3.

Figure 9:
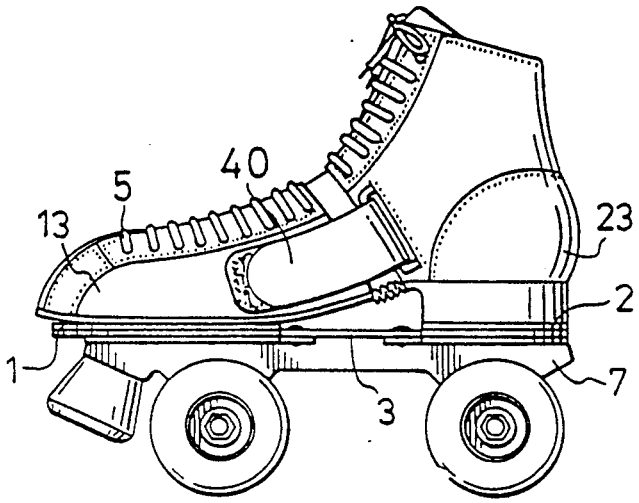
FIG. 9 shows a first kind of roller-skate shoe constructed by using the sole plate of the present invention.
Figure 10:
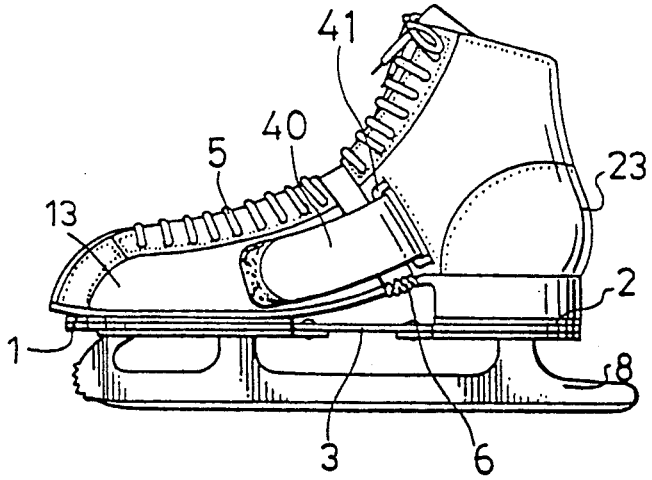
FIG. 10 shows a second kind of skate shoe constructed by using the sole plate of the present invention.
Figure 11:
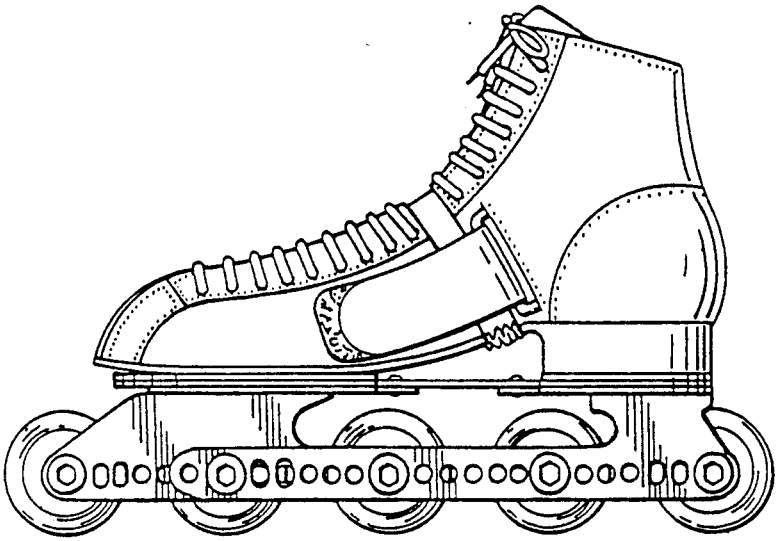
FIG. 11 shows a third kind of roller-skate shoe constructed by using the sole plate of the present invention.

A roller means (7) is attached to the bottom side of the sole plate of the shoe thereby obtaining a complete roller skate as shown in FIGS. 9 and 11. If the skater intends to use the shoe on an ice surface, a blade (8) can be attached to the sole plate of the shoe as shown in FIG. 10.

With the invention thus explained, it is obvious to those skilled in the art that several variations and modifications can be made without departing from the scope and spirit of the present invention. It is therefore intended that this invention be limited only in the appended claims.

I claim:

1. An adjustable shoe attachable to a skating means comprising:

a sole plate;

a front section and a rear section spaced from said front section by an adjustable distance, each of said front and rear sections having a fixing means by which to detachably attach said front and rear sections to said skating means, said front section having a toe cup on an upper side of said sole plate, said toe cup extending towards said rear section, and said rear section having a heel cup on the upper side of said sole plate, said heel cup extending towards said front section;

wherein said fixing means is a pair of elongated slots formed in a parallel manner on said front and rear sections respectively and screws inserted through said elongated slots to connect said front and rear sections to said skating means;

a connecting member which is provided between and interconnects said front and rear sections; and means on said connecting member and said front and rear sections for adjusting said spaced apart distance between said front and rear sections.

2. An adjustable shoe as claimed in claim 1, wherein said adjusting means is a pair of elongated slots formed on said connecting member which are spaced from and aligned with one another so that rivets inserted through said slots are connected to said front and rear sections.

3. An adjustable shoe according to claim 1, further comprising means or connecting said toe cup to said heel cup.

4. An adjustable shoe as claimed in claim 3, wherein said connecting means is a VELCRO strap having one portion attached to said toe cup and an other portion, to be fastened to said bone portion, threaded through a ring mounted on said heel cup.

5. An adjustable shoe as claimed in claim 1, wherein retractable straps are connected to said toe cup and heel cup.

6. An adjustable shoe according to claim 1, wherein the skating means is a roller skate.

7. An adjustable shoe according to claim 1, wherein the skating means is a roller blades.

8. An adjustable shoe according to claim 1, wherein the skating means is an ice skate.

9. A shoe comprising:

a front part and a rear pair movably connected to one another so as to be adjustable in size, said front part having a toe sole and an anterior shoe part fixed to said toe sole, sand said rear part having a heel sole and a posterior shoe part fixed to said heel sole;

a pleated sole part, disposed between said integrally connected to said toe sole and said heel sole, to enable extension and retraction of said toe sole and said heel sole from one another;

an instep gusset sheet extending from said anterior shoe part to said posterior shoe part strap means releasably interconnecting said front and rear part; and an adjustable mounting means for mounting said shoe on a skate means, said mounting means including a front plate fixed to said toe sole, a rear plate fixed to said heel sole, a connecting plate provided between sand slidably connected to said front and rear plates, and fastener means on said front and rear plates to attach said shoe to said skate means.

* * * * *